US005221946A

United States Patent [19]

Kohyama

[11] Patent Number: 5,221,946

[45] Date of Patent: Jun. 22, 1993

[54] IMAGE FORMING APPARATUS

[75] Inventor: Mitsuaki Kohyama, Tokyo, Japan

[73] Assignee: Kabushiki Kaisha Toshiba, Kawasaki, Japan

[21] Appl. No.: 694,761

[22] Filed: May 2, 1991

[30] Foreign Application Priority Data

May 15, 1990 [JP] Japan ..... 2-126398

[51] Int. Cl.[5] ..... G03G 15/06

[52] U.S. Cl. ..... 355/270; 118/656; 346/160.1

[58] Field of Search ..... 346/160.1; 355/268, 355/269, 270, 297; 118/651, 652, 656

[56] References Cited

U.S. PATENT DOCUMENTS 4,469,435 9/1984 Nosaki et al. ..... 118/652 X
4,664,504 5/1987 Oda et al. ..... 355/297
4,727,395 2/1988 Oda et al. ..... 355/270 X
4,769,676 9/1988 Mukai et al. ..... 355/269

*Primary Examiner*—Michael L. Gellner
*Assistant Examiner*—P. J. Stanzione
*Attorney, Agent, or Firm*—Foley & Lardner

[57] ABSTRACT

An image forming apparatus for forming a toner image. The apparatus includes a photosensitive drum, a laser device for forming a latent image on the photosensitive drum, a developing device for developing the latent image with a toner agent/and for cleaning the toner agent remaining on the photosensitive drum therefrom while the latent image is developed, a transfer device for transferring the developed image on the photosensitive drum to a recording medium such as a paper sheet, a disordering and charging device for disordering the toner agent remaining on the photosensitive drum after transfer of the developed image by the transfer device so as to render the developed image unreadable or non-patterned, and for charging the photosensitive drum at a predetermined potential while the toner agent remaining on the photosensitive drum is disordered and a bias source for supplying the disordering and charging device with a bias voltage having an AC bias voltage.

6 Claims, 3 Drawing Sheets

IMAGE FORMING APPARATUS

FIELD OF THE INVENTION

The present invention relates generally to an image forming apparatus, and, more particularly, to an image forming apparatus for developing an electrostatic latent image formed on a photosensitive drum, and for transferring the developed image on an image recording medium, such as paper.

BACKGROUND OF THE INVENTION

A conventional image forming apparatus includes electrophotographic devices, electrostatic printers, etc. In a conventional image forming apparatus, an electrostatic latent image is formed on a photosensitive drum. Toners are then electrostatically adhered to the latent image as developing agents, so that a toner image corresponding to the latent image is developed.

Subsequently, the toner image is transferred on an appropriate image recording medium, such as a copy sheet. After the completion of the image transferring, the electrostatic latent image and residual toner particles remain on the photosensitive drum. The residual toner particles are removed from the drum by a cleaning device. The electrostatic latent image is then removed from the photosensitive drum by a discharging device.

Recently, there has been demanded to reduce the size of the image forming apparatus into a compact shape. In this connection, a prior art Japanese Patent Disclosure No. Sho 47-11538 discloses an image forming apparatus having a reduced size. It uses a photosensitive drum having a reduced diameter and a device which serves as an image developing device and a cleaning device.

In the prior art, a photosensitive drum rotates twice in an image forming cycle. An image developing process is carried out by the device in the first rotation of the photosensitive drum, while a cleaning process is carried out by the device in the second rotation of the photosensitive drum.

The prior art, however, has some problems. That is, the image forming speed is halved in comparison to conventional devices, because the photosensitive drum must rotate twice in the one image forming cycle. Further, the size of image recording media, i.e., copy sheets, is limited to a relatively small sheet size, because the length of the copy sheets available for the apparatus is limited to less than the peripheral length of the photosensitive drum, and the photosensitive drum has a reduced diameter.

Another prior art, e.g., the U.S. Pat. No. 4,727,395 discloses an image forming apparatus having a device which carries out concurrently the image developing process and the cleaning process. The image forming cycle of the apparatus is performed within one rotation of its photosensitive drum. Thus, the latter prior art has reduced the size of the apparatus without lowering the image forming speed.

This latter prior art, however, has another problem. the residual latent image and the residual toner image still remain in the next image forming cycle. The charging process, the latent image forming process and the developing process in the next cycle are carried out on the residual latent image and the residual toner image. Thus, a resulting image formed in the next cycle is deteriorated by the residual images remaining from the preceding cycle. This kind of image deterioration becomes especially noticeable and unacceptable when a so-called solid area of the resultant image (i.e., a resultant toner image having a wide area) matches or overlaps the residual latent image. Moreover, the residual toner image also appears on the resultant image and deteriorates the image.

Thus, prior art image forming apparatuses fail to produce satisfactory distinct images.

SUMMARY OF THE INVENTION

It is, therefore, an object of the present invention to provide an image forming apparatus which is relatively reduced in size without damaging a resultant image.

In order to achieve the above object, an image forming apparatus according to one aspect of the present invention includes a photosensitive drum, a laser device for forming a latent image on the photosensitive drum, a developing device for developing the latent image with a toner agent, and for cleaning the toner agent remaining on the photosensitive drum therefrom while the latent image is developed, a transfer device for transferring the developed image on the photosensitive drum to a recording medium such as a paper sheet, a disordering and charging device for disordering the toner agent remaining on the photosensitive drum after transfer of the developed image by the transfer device so as to render the developed image unreadable or non-patterned, and for charging the photosensitive drum at a predetermined potential while the toner agent remaining on the photosensitive drum is disordered and a bias source for supplying the disordering and charging device with a bias voltage having an AC bias voltage.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
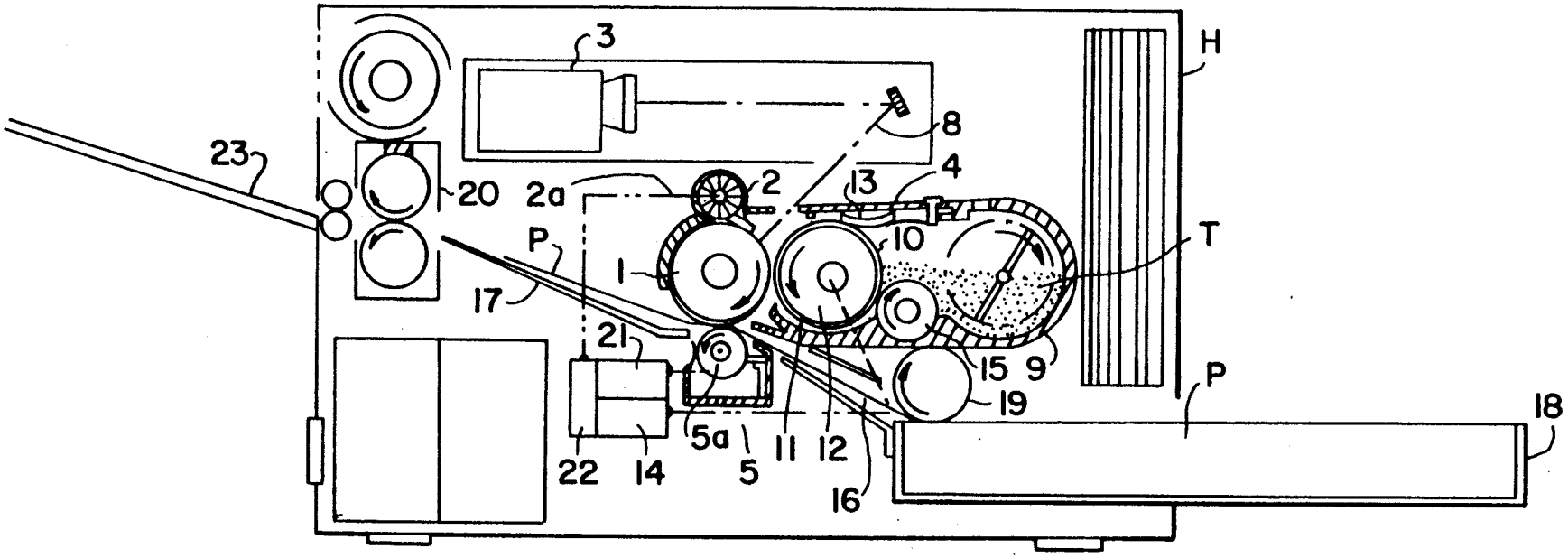
FIG. 1 is a section of an image forming apparatus according to an embodiment of the present invention.

The present invention will be described in detail with reference to the FIGS. 1 through 4. Throughout the drawings, like or equivalent reference numerals or letters will be used to designate like or equivalent elements for simplicity of explanation.

Referring now to FIG. 1, a preferred embodiment of the image forming apparatus according to the present invention will be described in detail. In FIG. 1, a photosensitive drum 1 is disposed substantially in the center of a housing H of the image forming apparatus. The photosensitive drum 1 is rotatable in the direction indicated by an arrow A at a predetermined speed, e.g., a peripheral speed of 80 mm/sec. The photosensitive drum 1 is formed by an organic photosensitive substance.

The photosensitive drum 1 is surrounded by a disordering and charging device 2, a laser device 3, a developing and cleaning device 4 and a image transfer device 5 in the order along the rotating direction A of the photosensitive drum 1.

Figure 2:
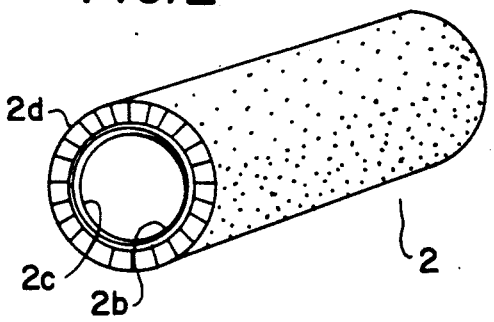
FIG. 2 is a perspective view of the disordering and charging device of FIG. 1.

Referring now to FIG. 2, the disordering and charging device 2 will be described in detail. In FIG. 2, the disordering and charging device 2 has a rotary cylinder **2*b*, a conductive layer 2*c* and conductive fibers 2*d***.

The conductive layer **2*c* is formed by an conductive adhesive coated on the rotary cylinder 2*b*. The conductive fibers 2*d* are planted on the rotary cylinder 2*b* through the conductive layer 2*c* at a density of 1,000 to 20,000 pcs./cm$^2$. The conductive fibers 2*d* elongated in the radial direction of the cylinder 2*b*, so that the disordering and charging device 2** has a diameter of 20 to 30 mm.

Each of the conductive fibers **2*d* has a length of 2 to 10 mm and a thickness of 30 to 100 $\mu$m. Further, the conductive fibers 2*d* have a resistance of $10^3$ to $10^9$ $\Omega$·cm. Typically, a Toleca (trademark) and a Kainol (trademark) are commercially available for the conductive fibers 2*d***.

The rotary cylinder **2*b* may be comprised of paper, plastics or metal. Further, the conductive layer 2*c* can be comprised of a conductive textile such as a velvet having the conductive fibers 2*d***.

The disordering and charging device 2 is mounted above the photosensitive drum 1. The disordering and charging device 2 rotates in contact with the photosensitive drum 1 at a peripheral speed 1 to 4 times faster than the peripheral speed of the photosensitive drum 1. The conductive fibers **2*d* are supplied with an AC bias biased by a first DC bias from a first power source 22 (see FIG. 1). Typically, the AC bias has a frequency of about 1 to 5 KHz and a peak-to-peak AC voltage of about 800 to 2,000 V, while the first DC bias has a DC voltage of about −400 to −1,000 V. The disordering and charging device 2 then uniformly charges the surface of the photosensitive drum 1 from −500 to −800 V. Further the disordering and charging device 2 mechanically disorders residual toners remaining on the photosensitive drum 1**.

The laser device 3 applies a laser beam 8 on the surface of the photosensitive drum 1 to expose the surface of the drum 1 in accordance with image information. This exposing process discharge the negative charge on the exposed portion. Thus, the exposed portion has a potential higher than the non-exposed portion. The laser beam 8 conveys image information, so that an electrostatic latent image in the form of charged areas or portions and non-charged portions is formed. The charged portion and non-charged portion correspond to the non-exposed portion and the exposed portion of the original being copied.

The developing and cleaning device 4 comprises a hopper 9, a developing and cleaning roller 10, a friction blade 13 and toner feeding roller 15. The hopper 9 contains therein fine particles of so-called non-magnetic one-component toner T as a developing agent. The particles of the one-component toner T have a volume average particle size of 6 to 15 $\mu$m. The toner T is fed to the developing and cleaning roller 10 disposed in the hopper 9 through the toner feeding roller 15 having a spongy structure.

The toner feeding roller 15 serves to feed the developing and cleaning roller 10 with the toner T, to rake the toner T for preventing a cohesion of the toner T in the hopper 9 and to collect excessive toner from the developing and cleaning roller 10 into the hopper 9.

The developing and cleaning roller 10 contacts the photosensitive drum 1 and the developing and cleaning roller 10, and transports the toner T to the photosensitive drum 1, so that the electrostatic latent image on the photosensitive drum 1 is developed to a toner image information. The developing and cleaning roller 10 cleans a residual toner from the photosensitive drum 1 into the hopper 9.

The developing and cleaning roller 10 comprises a roller shaft, a roller body and a cover layer. The roller shaft is supplied with a second DC bias from a second power source 14 (see FIG. 1) which will be described later. The roller body is made of elastic material such as foamed polyurethane, silicone rubber or diene rubber, so that the developing and cleaning roller 10 is elastic. The cover layer is made of conductive material with a resistance of $10^2$ to $10^8$ $\Omega$·cm.

The second power source 14 supplies the developing and cleaning roller 10 with the second DC bias of −100 to −400 V. A preferred value of the second DC bias is the range of −150 to −300 V.

The developing and cleaning roller 10 rotates in friction with friction blade 13, thus causing frictional electricity. The friction blade 13 can be made of phosphor bronze, polyurethane resin, silicone resin or a suitable combination thereof. Thus, the toner T on the developing and cleaning roller 10 is charged to about −5 to −30 $\mu$C/g by frictional electricity. The charge or a frictional charge charged on the toner T has the same polarity as the charge on the photosensitive drum 1, i.e., the negative charge which has been previously charged by the disordering and charging device 2.

The toner T with the negative charge is coated in one to three layers (6 to 45 $\mu$m in depth) on the photosensitive drum 1 by the developing and cleaning roller 10. Thus, a negative toner image is formed on the photosensitive drum 1 according to the electrostatic latent image on the photosensitive drum 1. Here the developing and cleaning roller 10 is coated with an elastic layer suitable to produce the frictional charge with the friction blade 13. The elastic layer may be constituted by, e.g., a mixture of polyurethane resin and 10 to 30 weight-percent of carbon.

The image transfer device 5 is pressed against the photosensitive drum 1 at a position below the photosensitive drum 1. The image transfer device 5 has an image transfer roller **5*a* similar to the developing and cleaning roller 10, except its resistance value. That is, the image transfer roller 5*a* has a resistance of $10^5$ to $10^{10}$ $\Omega$·cm at its surface. The image transfer roller 5*a* is supplied with a third DC bias from a third power source 21. Furthermore, the image transfer roller 5*a* is preferably coated by a layer having a high degree of smoothness and low friction, for facilitating easy cleaning or removing toners from the image transfer roller 5*a*. To this object, a conductive fluoropolymer or conductive polyester can be used for the layer of the image transfer roller 5*a***.

The rubber hardness of the entire image transfer roller **5*a* preferably ranges from 25° to 50°, as measured under the JIS (Japanese Industrial Standards) for providing a sufficient softness and for allowing the image transfer roller 5a a wide range of pressing force against the photosensitive drum 1**.

If a line load of 10 to 150 g/cm is applied to the developing and cleaning roller 10, and if the developing and cleaning roller 10 is brought into sliding contact with the photosensitive drum 1 at a peripheral speed of 1 to 4 times faster than that of the photosensitive drum 1, the nip width of 1 to 4 mm is obtained between the developing and cleaning roller 10 and the photosensitive drum 1. This sliding contact with the nip width causes a great frictional force between them, whereby it cleans or removes the residual toner off the photosensitive drum 1. Here, also the toner T is the type of one-component. Thus, a danger of causing any reduction of image quality, such as streaks, is prevented.

In the non-exposed portion, moreover, the electrostatic attraction of the second DC bias to the toner T is greater than that of the photosensitive drum 1. The toner T on the non-exposed portion is thus transferred to the developing and cleaning roller 10 and then collected into the hopper 9.

The toner particles in the hopper 9 are newly fed to the photosensitive drum 1 through the toner feeding roller 15 and the developing and cleaning roller 10. The exposed portion has a charge potential suitably higher than the that of the non-exposed portion, as described above. Thus, the toner particles reaching the photosensitive drum 1 adhere to the exposed portion rather than the non-exposed portion. Thus, the developing process is established.

The residual toner from the preceding cycle has been already scattered in small dots by the disordering and charging device 2, as described above. Thus, the residual toner can be effectively collected by the developing and cleaning roller 10.

A copying sheet P is fed between the photosensitive drum 1 and the image transfer roller 5a from a copy sheet feeding tray 18 through a first sheet transporting passage 16. The image transfer roller 5a applies a third DC bias of 800 to 2,000 V to the copying sheet P. The sheet P is thus charged to the positive potential, while the toner T on the photosensitive drum 1 is charged to the negative potential, so that the toner image is electrostatically transferred to the copying sheet P. This contacting type image transfer device 5 has a sufficient stability in such an image transfer operation, even in high humidity. This is highly advantageous for reducing the residual toner on the photosensitive drum 1 after the image transfer operation, so that the cleaning load of the developing and cleaning device 4 is reduced. This is also effective to prevent a mixing of paper dust into the toner on the photosensitive drum 1.

The sheet P thus carrying the toner image, i.e., a copied sheet P is supplied to a conventional image fixing device 20 through a second sheet transporting passage 17. The image fixing device 20 fixes the toner image on the sheet P according to a conventional manner. The sheet P thus having the fixed toner image is output to a copied sheet receiving tray 23.

In operation, the photosensitive drum 1 rotates in the direction indicated by the arrow A. The disordering and charging device 2 coupled to the first power source 22 charges the photosensitive drum 1 to about −500 to −800 V. Subsequently, the laser device 3 applies the laser beam 8 conveying image information. Thereby an electrostatic latent image is formed on the photosensitive drum 1. The latent image on the photosensitive drum 1 is here assumed to present a negative image.

The photosensitive drum further rotates in the direction so that the latent image faces the developing and cleaning device 4. The latent image is then developed by the toner T fed by the developing and cleaning roller 10. The developing and cleaning roller 10 is pressed against the photosensitive drum 1, so that the photosensitive drum 1 undergoes an elastic deformation. This causes the developing and cleaning roller 10 to contact with the photosensitive drum 1 with a predetermined nip width which ensures coating by the toner T on the photosensitive drum.

The toner T has the negative charge which is the same as the charge on the photosensitive drum 1, as described above. Thus, a reverse development is accomplished and a toner image in the form of a so-called positive image is established on the photosensitive drum 1.

The toner T is charged to about −5 to −30 μC/g, by friction.

The photosensitive drum 1 further rotates and the toner image reaches the image transfer device 5. The toner image is then transferred to the copy sheet P fed through the first sheet transporting passage 16. The sheet P, thus conveying the toner image, is output to the copied sheet receiving tray 23 after served the image fixing operation in the image fixing device 20.

Even after the developing process, the latent image still remains on the photosensitive drum 1. Also the toner image may not entirely transfer to the copy sheet P. Thus, a residual toner also remains on the photosensitive drum 1 after the developing process. Here it is assumed that the residual toner still presents a faint toner image.

The photosensitive drum 1 further rotates and the latent image and the residual toner reach the disordering and charging device 2. The disordering and charging device 2 has the conductive fibers 2d, as described above in reference to FIG. 2. The disordering and charging device 2 rotates in contact with the photosensitive drum 1 at the peripheral speed 1 to 4 times faster than the peripheral speed of the photosensitive drum 1, while the conductive fibers 2d are biased to about −500 to −800 V by the first power source 22, as described before.

Thus, the disordering and charging device 2 mechanically disorders the faint toner image remaining on the photosensitive drum 1, and also charges the photosensitive drum 1 to about −500 to −800 V. The charge of about −500 to −800 V also electrostatically disorders the residual toner on the photosensitive drum 1. This is because the residual toner has a negative charge the same as the polarity of the charge applied by the disordering and charging device 2. The disordering and charging device 2 does not completely remove the residual toner from the photosensitive drum 1. Thus, it may be said that the disordering and changing device 2 serves to disorder the faint toner image so as to render the developed image unreadable or nonpatterned, and to charge the photosensitive drum 1 at a predetermined potential while the residual toner remaining on the photosensitive drum 1 is disordered for preparation of the succeeding image forming cycle.

In the disordering process carried out both mechanically and electrostatically, the residual toner presenting the faint toner image is scattered on the photosensitive drum 1. The toner particles thus disordered or scattered on the photosensitive drum 1 are distributed in clusters too small to have charactor information or the like.

Thus, if the scattered residual toner is transferred to the copy sheet in a succeeding image forming cycle, the toner image corresponding to the residual toner in the preceding cycle fails to have meaningful information. In the other words, the residual toner presenting the faint toner image is disordered or scattered, so that it becomes unreadable.

The disordering and charging device 2 is located in the position above the photosensitive drum 1. Thus, the residual toner brushed off from the photosensitive drum 1 by the conductive fibers 2*d* still stays on the photosensitive drum 1 and then drops into the hopper 9 when it reaches the position of the developing and cleaning device 4. This is also advantageous for preventing the toner from scattering to the other portions of the apparatus.

Although the toner particles thus scattered reach a position facing the laser device 3, the laser beam 8 applied to the photosensitive drum 1 from the laser device 3 is not substantially disturbed by the toner particles. Thus, the photosensitive drum 1 is sufficiently exposed without causing an irregular exposure.

Figure 3:
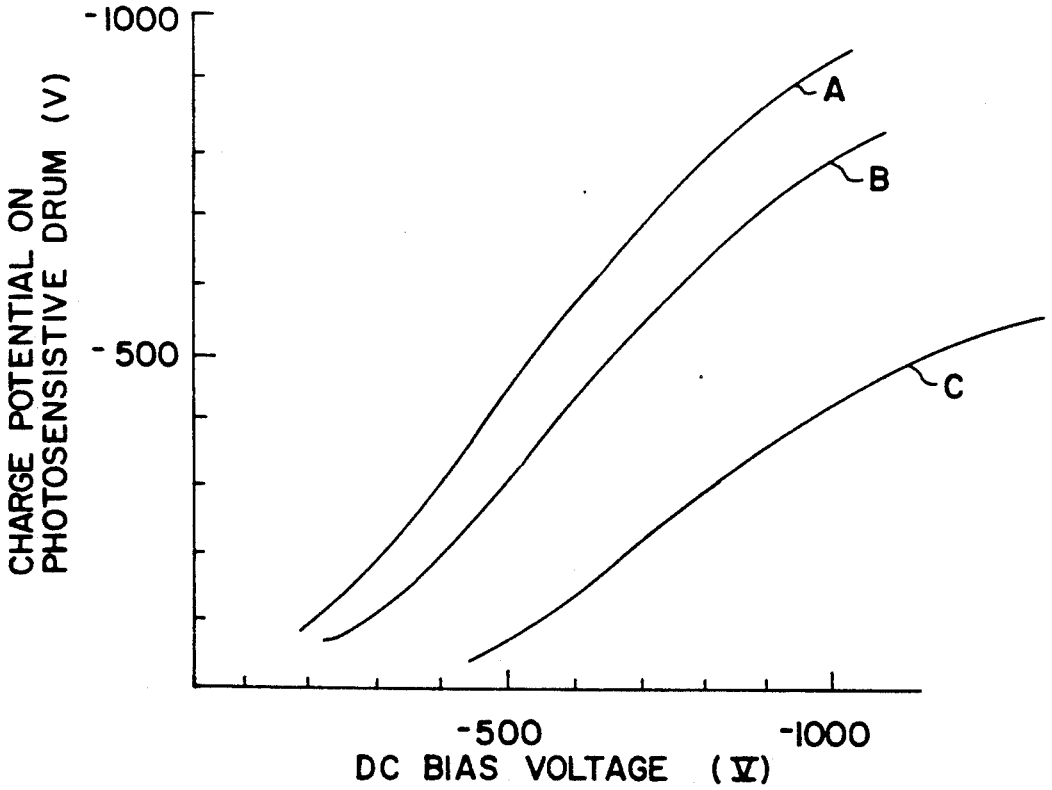
FIG. 3 is a graph showing a charge characteristics of the disordering and charging device of FIG. 2.

Referring now to FIG. 3, charge characteristics of the disordering and charging device 2 will be described. FIG. 3 shows an example of the charge characteristics measured on a sample of the disordering and charging device 2 implemented in the present invention. The Y-coordinate shows the charge potential on the photosensitive drum 1, while the X-coordinate shows the DC bias voltage of the first power source 22, which is applied to the disordering and charging device 2 together with an AC bias, as described above. Graph A is a charge characteristic when a first AC bias with a frequency of 2 KHz and a peak-to-peak AC voltage of 1,500 V is simultaneously applied. Graph B is a charge characteristic when a second AC bias with a frequency of 2 KHz and a peak-to-peak AC voltage of 1,000 V is simultaneously applied. Graph C is a reference graph showing a charge characteristic when no AC bias is applied.

As is easily seen from the Graphs A, B and C, the disordering and charging device 2 is able to effectively charge the photosensitive drum 1 when an AC bias is used together with a DC bias. For example, when the first AC bias is used (see Graph A), a charge potential of −500 V was obtained by a relatively low DC bias voltage of about −500 to −550 V.

As a result of a check on resultant images formed under the bias conditions of the DC bias voltage of −500 to −550 V and the AC bias of the peak-to-peak voltage over 1,000 V, residual images were not substantially recognized.

As a result of visual check on the resultant images formed under the bias condition of only the DC bias (see Graph C), some residual images, presenting brushing traces caused by the conductive fibers 2*d* of the disordering and charging device 2, were recognized. On the other hand, in the case of resultant images formed under the bias conditions of the DC bias voltage of −500 to −550 V and the AC bias of the peak-to-peak voltage over 1,000 V, residual images were not substantially recognized.

Figure 4:
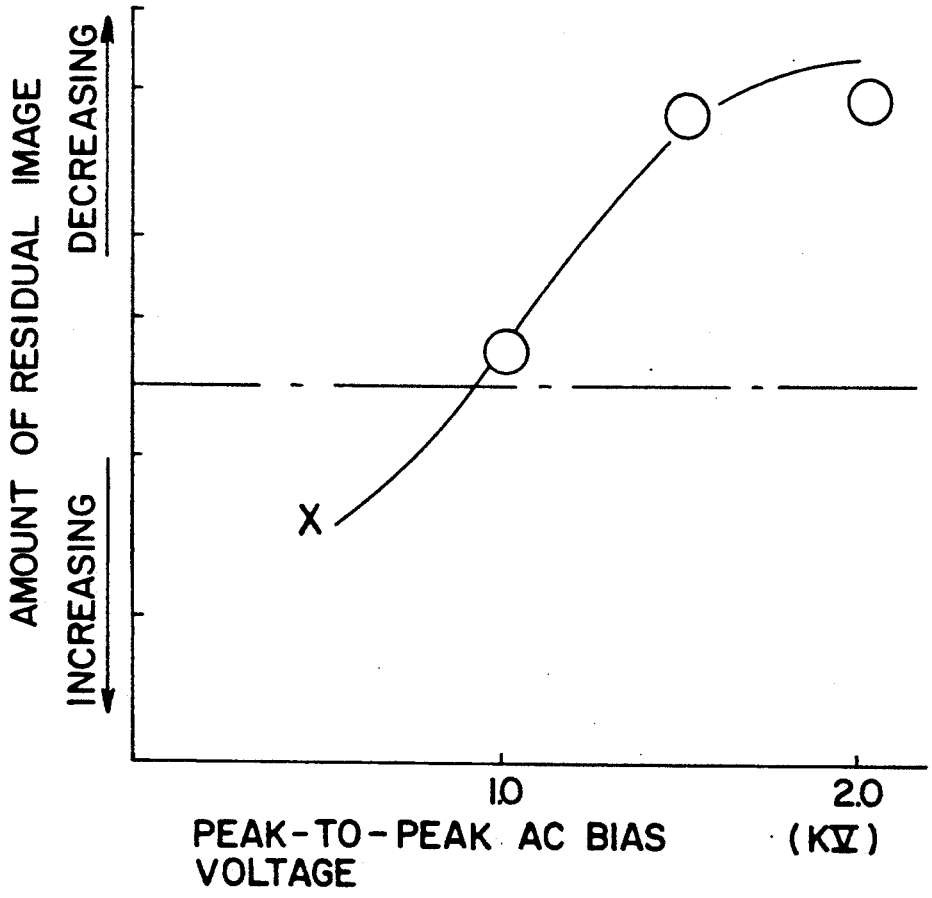
FIG. 4 is a graph showing results of a residual image eliminating test implemented on the embodiment of the image forming apparatus according to the present invention.

FIG. 4 shows a result of another test carried out for examining the influence of the AC bias against the residual images. In the test, DC biases applied to the conductive fibers 2*d* of the disordering and charging device 2 and the developing and cleaning roller 10 were kept at −500 V and −200 V, respectively, while the AC bias with the frequency of 2 KHz was varied. The Y-coordinate shows the frequency of samples having good resultant images which were checked with the eye. The result of the test were given by a manner of relative comparison, so that the Y-coordinate simply indicates frequency without dimension. Thus, the upward direction of the Y-coordinate indicates a frequency with good resultant images. While the downward direction indicates a lower frequency with good resultant images. Here, the term of the good resultant image means that a residual image is not substantially recognized on the resultant image.

As is seen from FIG. 4, the peak-to-peak voltage over 1,000 V of the AC bias is effective to sufficiently reduce the residual image, when the AC bias has frequency of 2 KHz.

According to the embodiment of the image forming apparatus, residual toner images can be remarkably reduced. Further, residual toners can also be removed without a particular device such as a conventional cleaning device. A test piece of the image forming apparatus according to the present invention were examined by a practical copying operation in which 20,000 copies where produced from image information having an image area of 7% per A4-size area.

As a result of the copying test, all of the 20,000 copies were satisfactory and any defect of residual images was not occurred.

Further, by suitably adjusting the DC and AC biases, the charge potential on the photosensitive drum 1, the disordering operation of the disordering and charging device 2, the toner collecting operation and the toner applying operation of the developing and cleaning device 4 can be easily adjusted.

In the above embodiment, the disordering and charging device 2 can be supplied with the negative DC potential from the first power source 22, as described above. In a long term operation of the apparatus, the toner particles accumulate in gaps of the conductive fibers 2*d*. This toner accumulation, however, can be slowed by adjusting the biases. It is also possible to remove the accumulated toner from the fiber gaps by temporarily applying a suitable positive voltage of DC bias, e.g., 100 to 300 V and/or AC bias with a relatively large peak-to-peak voltage. The toner then gathers on the photosensitive drum 1, but the toner can be collected in the hopper 9 when it reaches the position facing the developing and cleaning device 4 in the manner as described above.

The above embodiment uses the non-magnetic one-component toner as the developing agent. However, in the present invention, many other image forming systems, e.g., a magnetic one-component toner brushing system, a fur-brushing system, a cascade system, etc. may be also employed.

Further, the disordering and charging device is not limited to the use of fibers. For example, the disordering and charging device can use any other elastic body, such as a foamed body. Furthermore, the disordering and charging device can be constructed by a stationary member rather than the rotating member.

As described above, the present invention can provide an extremely preferable image forming apparatus.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An image forming apparatus comprising:

means for forming a latent image on an image bearing member;

developing-cleaning means constituted as a single unit for developing the latent image with a non-magnetic, one-component developing agent, and for simultaneously removing residual developing agents remaining on the image bearing member therefrom, the developing-cleaning means having an elastic developing roller contacting the image bearing member, for carrying the non-magnetic, one-component developing agent to the image bearing member;

means for transferring the developed image on the image bearing member to a recording medium;

charging-disordering means constituted within a single unit for disordering the residual developing agent remaining on the image bearing member after the transferring of the developed image by the transferring means, so as to render the residual developed image unreadable or nonpatterned, and for simultaneously charging the image bearing member at a predetermined potential during the disordering of residual developing agent on the image bearing member, the charging-disordering means having a conductive member contacting the image bearing member; and means for supplying the charging-disordering means with a bias voltage having an AC component for transferring toner accumulated on the charging-disordering means onto the image bearing member.

2. The image forming apparatus as claimed in claim 1, wherein the conductive elastic body has conductive fibers on its exterior surface for said charging and disordering.

3. The image forming apparatus as claimed in claim 2, wherein each of the conductive fibers has a length of about 2 to 10 mm and a thickness of about 30 to 100 μm.

4. The image forming apparatus as claimed in claim 2, wherein each of the conductive fibers has a resistance of about $10^3$ to $10^9$ Ω/cm.

5. The image forming apparatus as claimed in claim 1, wherein the developing and cleaning means has a means for charging the developing agent having a charge with the same polarity as the charge on the image bearing member.

6. The image forming apparatus as claimed in claim 1, wherein the AC bias voltage has a frequency of about 1 to 5 KHz and a peak-to-peak AC voltage of about 800 to 2,000 V.

* * * * *